US006282389B1

(12) United States Patent
Matsuzaki et al.

(10) Patent No.: US 6,282,389 B1
(45) **Date of Patent: *Aug. 28, 2001**

(54) ELECTROPHOTOGRAPHIC PHOTOSENSITIVE DRUM, PROCESS CARTRIDGE AND ELECTROPHOTOGRAPHIC IMAGE FORMING APPARATUS

(75) Inventors: Hiroomi Matsuzaki, Mishima; Akira Suzuki, Odawara; Kazuo Chadani, Shizuoka-ken, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 163 days.

(21) Appl. No.: 09/399,817

(22) Filed: Sep. 21, 1999

(30) Foreign Application Priority Data

Sep. 24, 1998 (JP) ..... 10-287299

(51) Int. Cl.[7] ..... G03G 15/00
(52) U.S. Cl. ..... 399/111; 399/167
(58) Field of Search ..... 399/111, 116, 399/117, 167

(56) References Cited

U.S. PATENT DOCUMENTS

| | | | | |
|---|---|---|---|---|
| 4,829,335 | * | 5/1989 | Kanemitsu et al. . | |
| 5,126,800 | | 6/1992 | Shishido et al. | 355/211 |
| 5,432,590 | * | 7/1995 | Nomura et al. . | |
| 5,652,647 | * | 7/1997 | Yashiro et al. | 399/111 |
| 5,669,042 | * | 9/1997 | Kobayashi et al. | 399/111 |
| 5,926,672 | * | 7/1999 | Nishibata et al. | 399/111 |
| 5,943,529 | | 8/1999 | Miyabe et al. | 399/111 |
| 5,966,567 | | 10/1999 | Matsuzaki et al. | 399/111 |
| 6,011,941 | | 1/2000 | Takashima et al. | 399/111 |
| 6,016,416 | * | 1/2000 | Kitamura | 399/167 |

FOREIGN PATENT DOCUMENTS 2-166470 6/1990 (JP) .

* cited by examiner

*Primary Examiner*—Richard Moses
(74) *Attorney, Agent, or Firm*—Fitzpatrick, Cella, Harper & Scinto

(57) ABSTRACT

An electrophotographic photosensitive drum for use in a main body of an electrophotographic image forming apparatus, includes a cylinder having a photosensitive member on the periphery, a first helical gear provided at one end of the cylinder, and a second helical gear provided at the other end of the cylinder and having the same hand helix as the first helical gear and a number of teeth less than that of the first helical gear.

31 Claims, 5 Drawing Sheets

ELECTROPHOTOGRAPHIC PHOTOSENSITIVE DRUM, PROCESS CARTRIDGE AND ELECTROPHOTOGRAPHIC IMAGE FORMING APPARATUS

BACKGROUND OF THE INVENTION

1. Field of the Invention

The present invention relates to a process cartridge and an electrophotographic image forming apparatus in which the process cartridge is detachably mountable.

The electrophotographic image forming apparatus forms an image on a recording medium utilizing an electrophotographic image forming process, and includes, for example, an electrophotographic copying apparatus, an electrophotographic printer (such as an LED printer, a laser beam printer etc.), an electrophotographic facsimile apparatus and an electrophotographic word processor.

Also, the process cartridge integrally includes charging means, developing means or cleaning means and an electrophotographic photosensitive member as a cartridge, which is rendered detachably mountable in a main body of an electrophotographic image forming apparatus. Also, the process cartridge integrally includes at least one of the charging means, developing means and cleaning means with an electrophotographic photosensitive member as a cartridge, which is rendered detachably mountable in a main body of an electrophotographic image forming apparatus. Furthermore the process cartridge integrally includes at least the developing means and the electrophotographic photosensitive member as a cartridge, which is rendered detachably mountable in a main body of an electrophotographic image forming apparatus.

2. Related Background Art

The recent electrophotographic image forming apparatus for forming an image on the recording medium utilizing an electrophotographic image forming process often employs the process cartridge system in which the electrophotographic photosensitive member and process means for acting thereon are integrally made into a cartridge that is detachably mountable in the main body of the image forming apparatus. Such process cartridge system can significantly improve operability since the maintenance of the apparatus need not be executed by a service personnel but can be achieved by the user himself. For this reason, the process cartridge system is widely employed in the image forming apparatus.

In the electrophotographic image forming apparatus in which the process cartridge is detachably mountable for forming an image on the recording medium, the photosensitive drum provided in the process cartridge is given a driving force from the driving source of the main body of the apparatus through a driving force transmitting member. As an example, an output gear constituting the driving force transmitting member in the main body of the image forming apparatus meshes with a gear (called drum gear) provided on the photosensitive drum. Also, for driving the transfer roller, a transfer roller gear concentric with the transfer roller meshes with a gear fixed to the photosensitive drum. In such configuration, the drum gear is a helical gear while the transfer roller gear is a spur gear.

SUMMARY OF THE INVENTION

The present invention is an extended improvement of the conventional technology described above.

An object of the present invention is to provide an electrophotographic photosensitive drum, a process cartridge and an electrophotographic image forming apparatus capable of achieving smooth transmission of the driving force.

Another object of the present invention is to provide an electrophotographic photosensitive drum, a process cartridge and an electrophotographic image forming apparatus capable of reducing the unevenness in the rotation of the electrophotographic photosensitive drum.

Still another object of the present invention is to provide a process cartridge and an image forming apparatus, capable of achieving smooth transmission of the driving force from the main body of the apparatus to an electrophotographic photosensitive member and from the electrophotographic photosensitive member to transfer means, thereby reducing unevenness and vibration in the rotation of the electrophotographic photosensitive member and the transfer means and obtaining a satisfactory image.

Still another object of the present invention is to provide an electrophotographic photosensitive drum comprising a cylinder having a photosensitive member on the periphery thereof, a first helical gear provided at one end of the cylinder, a second helical gear provided at the other end of the cylinder and having a same hand helix as that of the first helical gear and a number of teeth less than that of the first helical gear, a process cartridge employing the above-mentioned electrophotographic photosensitive drum, and an electrophotographic image forming apparatus in which the above-mentioned process cartridge is detachably mountable.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Now the present invention will be clarified in detail by the preferred embodiments thereof. In the following description, the shorter or lateral direction of the process cartridge B means a direction along which the process cartridge B is mounted to or detached from the main body 14 of the apparatus, and coincides with the conveying direction of the recording medium. Also, the longer or longitudinal direction of the process cartridge B means a direction crossing (substantially perpendicular to) to the direction of mounting or detaching the process cartridge B into or from the main body 14 of the apparatus and is crosses (substantially perpendicular to) to the conveying direction of the recording medium.

Figure 1:
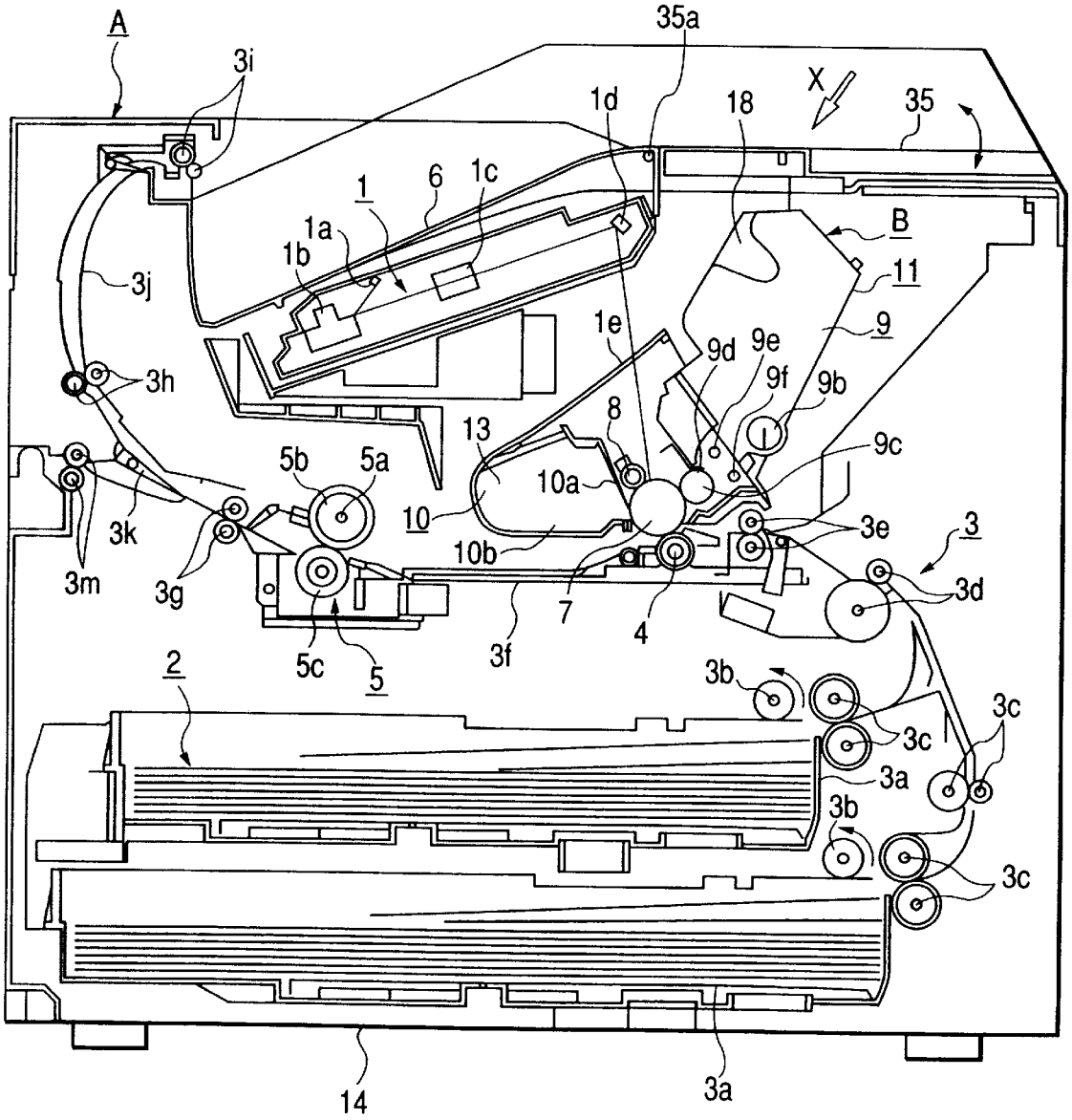
FIG. 1 is a lateral cross-sectional view of an electrophotographic image forming apparatus in which an embodiment of the present invention is applied.
Figure 2:
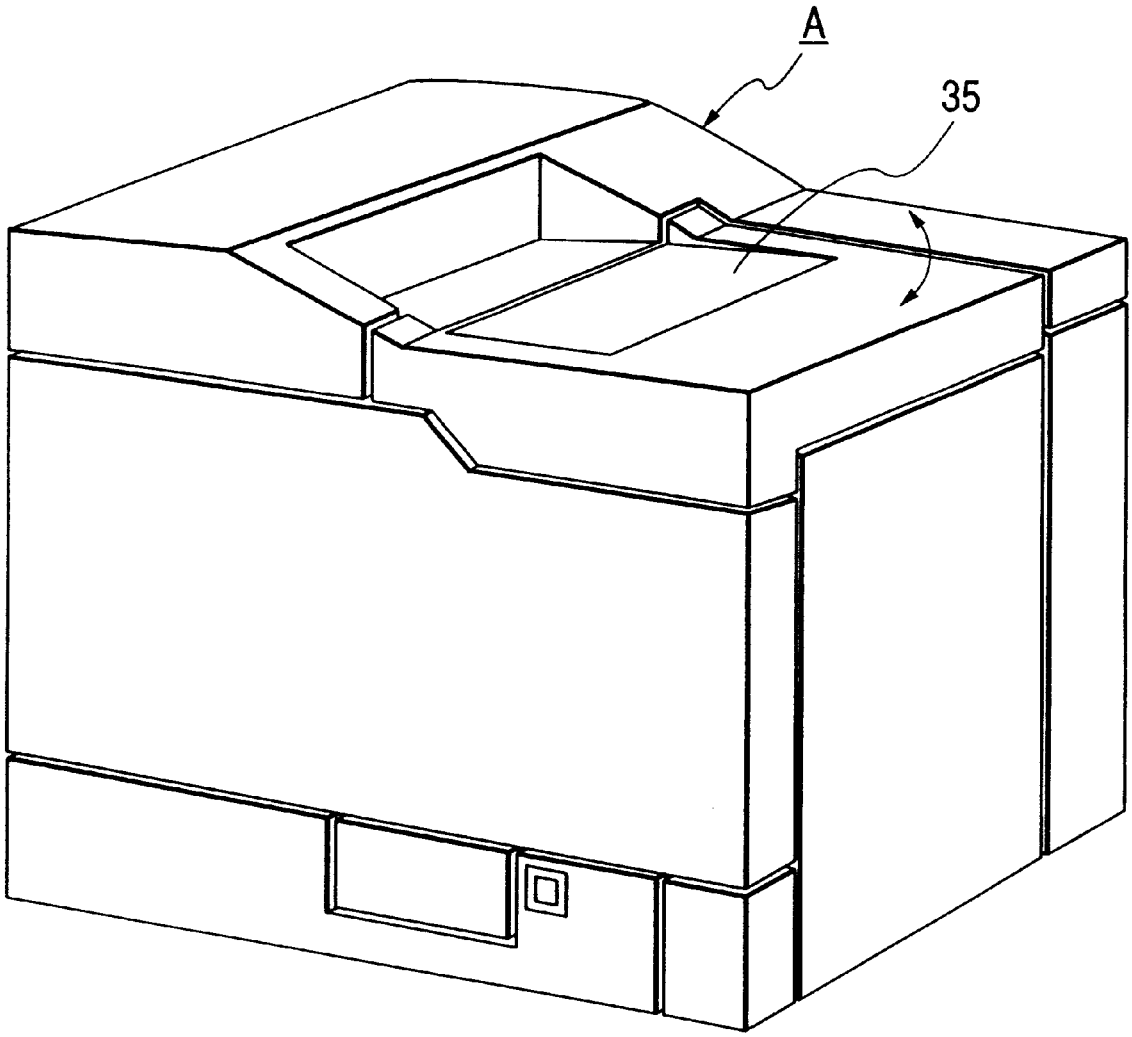
FIG. 2 is an external perspective view of the apparatus shown in FIG. 1.
Figure 3:
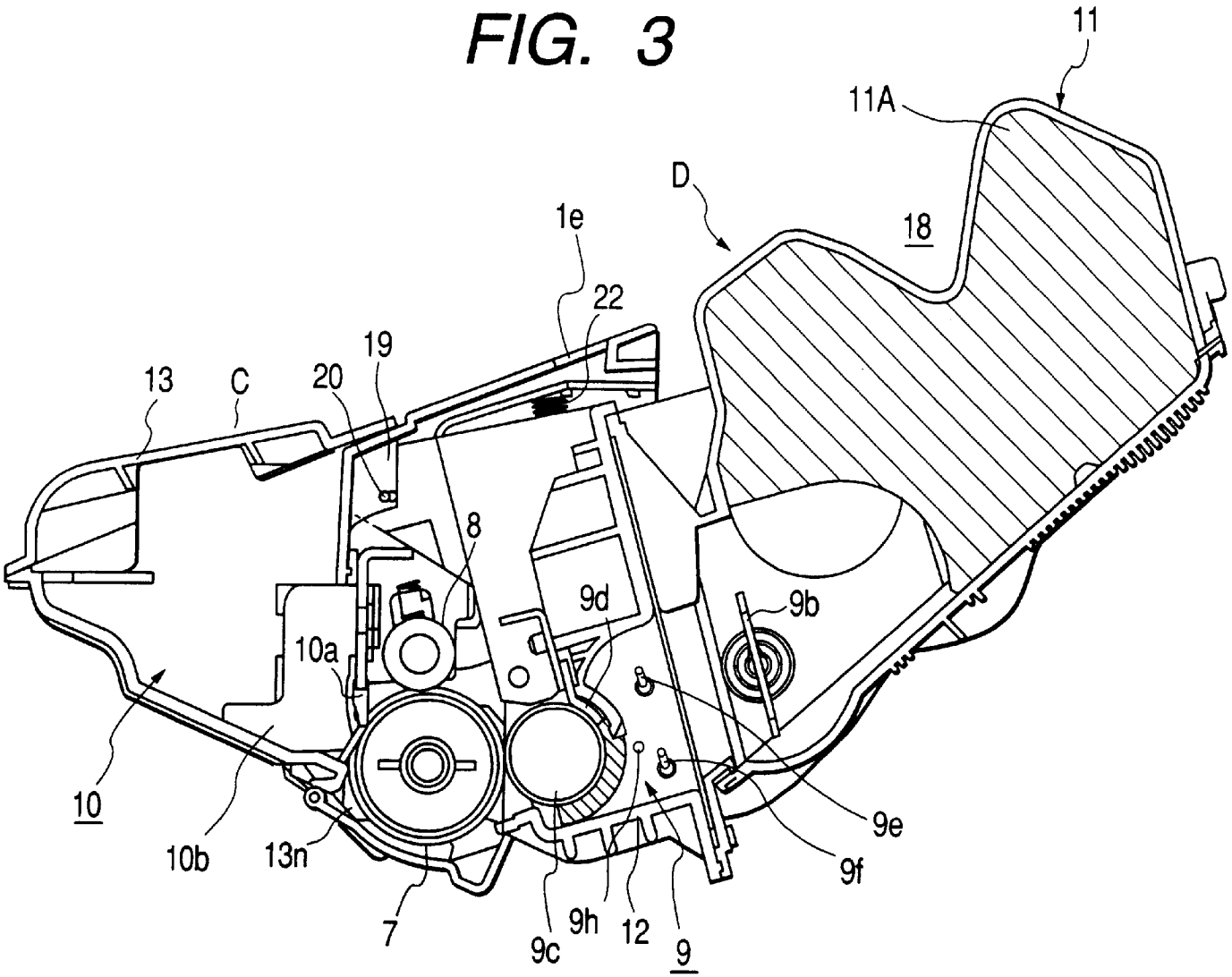
FIG. 3 is a lateral cross-sectional view of a process cartridge embodying the present invention.
Figure 4:
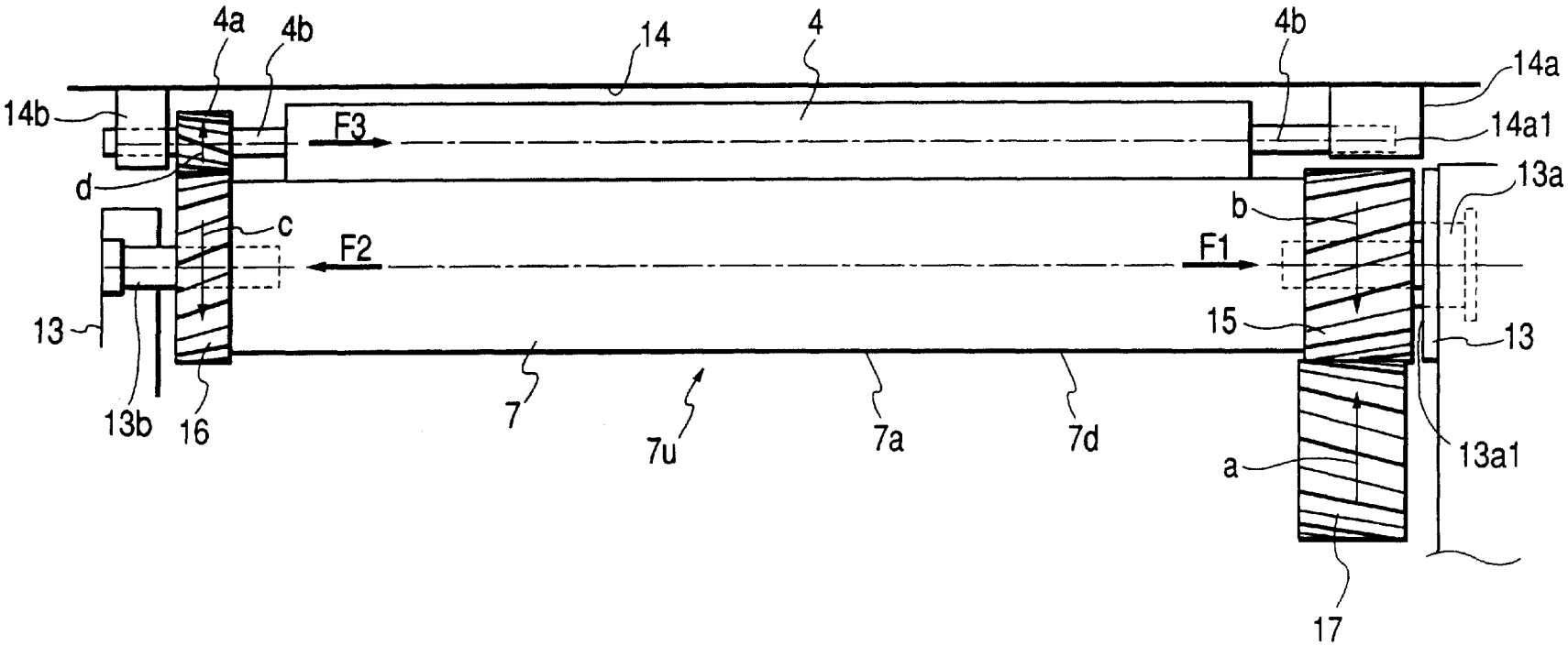
FIG. 4 is a schematic developed view of a driving system around a photosensitive drum embodying the present invention.

FIG. 1 is a cross-sectional view showing the configuration of an electrophotographic image forming apparatus (laser beam printer) embodying the present invention, and FIG. 2 is an external perspective view thereof. FIGS. 3 and 4 illustrate a process cartridge embodying the present invention, and respectively are a lateral cross-sectional view of the process cartridge and a schematic view showing the driving system around the photosensitive drum. Also, in the following description, the upper surface of the process cartridge B refers to a surface thereof positioned above when it is mounted in the main body 14 of the apparatus, and the lower surface refers to a surface thereof positioned below.

[Electrophotographic Image Forming Apparatus A and Process Cartridge B]

At first there will be explained, with reference to FIGS. 1 and 2, a laser beam printer A as the electrophotographic image forming apparatus embodying the present invention. Also a process cartridge B is illustrated, in a lateral cross-sectional view, in FIG. 3.

As shown in FIG. 1, the laser beam printer A forms an image on a recording medium (for example a recording paper, an OHP sheet or cloth) by an electrophotographic image forming process. A toner image is formed on a drum-shaped electrophotographic photosensitive member (hereinafter referred to as photosensitive drum). More specifically, the photosensitive drum is charged by charging means, and is then irradiated by optical means with a laser beam bearing image information to form a latent image corresponding to the image information on the photosensitive drum. The latent image is developed with developing means to obtain a toner image. In synchronization with the above-described formation of the toner image, a recording medium 2 set in a sheet cassette 3*a* is reversed and conveyed by a pickup roller 3*b*, pairs of conveying rollers 3*c*, 3*d* and a pair of registration rollers 3*e*. Then, the toner image formed on the photosensitive drum provided in the process cartridge B is transferred onto the recording medium 2 by the application of a voltage to a transfer roller 4 as transfer means. Subsequently, the recording medium 2 bearing the transferred toner image is conveyed by a conveying guide 3*f* to fixing means 5, which is provided therein with a driving roller 5*c* and a fixing roller 5*b* incorporating a heater 5*a* and which applies heat and pressure to the passing recording medium 2, thereby fixing the transferred toner image. Then, the recording medium 2 is conveyed by paired discharge rollers 3*g*, 3*h*, 3*i* and discharged to a discharge tray 6 through a surface reverse path 3*j*. The discharge tray 6 is provided on the upper surface of the main body 14 of the image forming apparatus A. It is also possible, by activating a pivotally movable flapper 3*k*, to discharge the recording medium 2 by paired discharge rollers 3*m* without passing through the surface reverse path 3*j*. In the present embodiment, the pickup roller 3*b*, paired conveying rollers 3*c*, 3*d*, paired registration rollers 3*e*, conveying guide 3*f*, paired discharge rollers 3*g*, 3*h*, 3*i* and paired discharge rollers 3*m* constitute conveying means 3.

On the other hand, in the process cartridge B as shown in FIG. 3, a photosensitive drum 7 having a photosensitive layer (not shown) is rotated and the surface of the drum is uniformly charged by the application of a voltage to a charging roller 8 constituting charging means. Then, a laser beam coming from an optical system 1 and bearing image information irradiates the photosensitive drum 7 through an exposure aperture 1*e* to form a latent image. This latent image is developed with developing means 9, employing toner. More specifically, the charging roller 8 is positioned in contact with the photosensitive drum 7 and charges the photosensitive drum 7 while being rotated by the photosensitive drum 7. The developing means 9 develops the latent image formed on the photosensitive drum 7, by supplying the developing area thereof with toner. The optical system 1 is provided with a laser diode 1*a*, a polygon mirror 1*b*, a lens 1*c* and a reflection mirror 1*d*.

The developing means 9 advances the toner in a toner container 11A toward the developing roller 9*c* by the rotation of a toner feeding member 9*b*. While the developing roller 9*c*, incorporating stationary magnets therein, is rotated, a toner layer with triboelectricity generated by a developing blade 9*d* is formed on the surface of the developing roller 9*c*, whereby the toner is supplied to the developing area of the photosensitive drum 7. Thus, the toner is transferred onto the photosensitive drum 7 according to the aforementioned latent image, thereby forming a visible toner image. The developing blade 9*d* defines the amount of the toner present on the periphery of the developing roller 9*c*. In the vicinity of the developing roller 9*c*, toner agitating members 9*e*, 9*f* are rotatably provided for circulating the toner in the developing chamber.

The toner image formed on the photosensitive drum 7 is transferred onto the recording medium 2 by the application, to the transfer roller 4, of a voltage of a polarity opposite to that of the toner image, and then residual toner remaining on the photosensitive drum 7 is removed by cleaning means 10. The cleaning means 10 scrapes off the residual toner remaining on the photosensitive drum 7 by an elastic cleaning blade 10*a* so maintained as to abut against the photosensitive drum 7, and collects the scraped toner in a waste toner reservoir 10*b*.

In the process cartridge B, a developing unit D is constructed by combining a toner frame 11 provided with a toner container (toner containing portion) 11A for containing toner therein and a developing frame 12 supporting the developing means 9 such as the developing roller 9*c*. Also, a cleaning unit C is constructed by a cleaning frame 13 supporting the photosensitive drum 7, the cleaning means 10 such as the cleaning blade 10*a* and the charging roller 8, and the process cartridge B is constructed by combining the developing unit D and the cleaning unit C. The process cartridge B can be mounted to and detached from the main body 14 of the apparatus by the operator.

The process cartridge B is provided with an exposure aperture 1*e* for exposing the photosensitive drum 7 to the laser light bearing the image information and a transfer aperture 13*n* for allowing the photosensitive drum 7 to be opposed to the recording medium 2. The exposure aperture 1*e* is formed in the cleaning frame 13, while the transfer aperture 13*n* is formed between the developing frame 12 and the cleaning frame 13.

In the following there will be explained the configuration of the housing of the process cartridge B of the present embodiment.

The process cartridge B of the present embodiment contains the photosensitive drum 7, the charging roller 8, the developing means 9 and the cleaning means 10 in a housing formed by combining the toner frame 11 and the developing frame 12 and rotatably combining the cleaning frame 13 thereto. Such process cartridge B is detachably mountable on cartridge mounting means provided in the main body 14 of the apparatus.

[Configuration of Housing of the Process Cartridge B]

In the process cartridge B of the present embodiment, the housing is constituted by combining the toner frame 11, the developing frame 12 and the cleaning frame 13 as explained in the foregoing, and the configuration of such housing will be explained in the following.

As shown in FIG. 3, the toner frame 11 rotatably supports the toner feeding member 9*b*. Also the developing frame 12 supports the developing roller 9*c* and the developing blade 9*d*, and rotatably supports the agitating members 9*e*, 9*f* in the vicinity of the developing roller 9*c*, in order to circulate the toner within the developing chamber. Also, an antenna rod 9*h* is mounted substantially parallel to the developing roller 9*c*, in opposed relationship to the longitudinal direction of the developing roller 9*c*. The toner frame 11 and the developing frame 12 are welded (by ultrasonic welding in the present embodiment) to form a second integral frame as the developing unit D.

On the other hand, the cleaning frame 13 constitutes the waste toner reservoir 10*b* and rotatably supports the charging roller 8 and the photosensitive drum 7, thereby constituting the cleaning unit C.

The developing unit D and the cleaning unit C are combined by connecting the cleaning frame 13 and the developing frame 12 with a connecting pin 20 and positioning a compression coil spring 22 between the cleaning frame 13 and the proximal end portion of an arm 19 of the developing frame 12 having the connecting pin 20 at the distal end portion, whereby the photosensitive drum 7 and the developing roller 9*c* are maintained in pressure contact by the biasing moment of the coil spring around the connecting pin 20.

An unrepresented gear, concentric with the developing roller 9*c* and fixed thereto meshes with a drum gear 15 whereby the developing roller 9*c* is rotated by the photosensitive drum 7 and the photosensitive drum 7 maintained in pressure contact with the developing roller 9*c* generates a load torque based on the load of the bearing.

[Mounting Means for Process Cartridge]

When an openable and closable cover 35, articulated to the main body 14 of the apparatus by a hinge 35*a*, is opened upwards in FIG. 1, there are exposed guide members (not shown) having guide rails and provided on both lateral inner walls of the main body 14. The operator supports the process cartridge B by applying fingers in a recess 18 provided in the toner frame 11, and inserts the process cartridge B from the side of the cleaning frame 13 in the lateral direction indicated by the arrow X, in such a manner that bosses (not shown) protruding outwardly in the longitudinal direction of the cartridge frame and coaxial with the photosensitive drum 7 of the process cartridge B and ribs (not shown) positioned behind the bosses in the mounting direction of the process cartridge B move along the above-mentioned guide rails, until the bosses of the process cartridge B fit into positioning grooves at the rear end of the guide rails to define the position of the process cartridge B. The printing operation is enabled by closing the openable and closable cover 35 after the process cartridge B is mounted in the main body 14 of the apparatus.

The process cartridge B can be detached from the main body 14 of the apparatus by a procedure inverse to that explained above.

[Configuration of Cleaning Unit]

Figure 5:
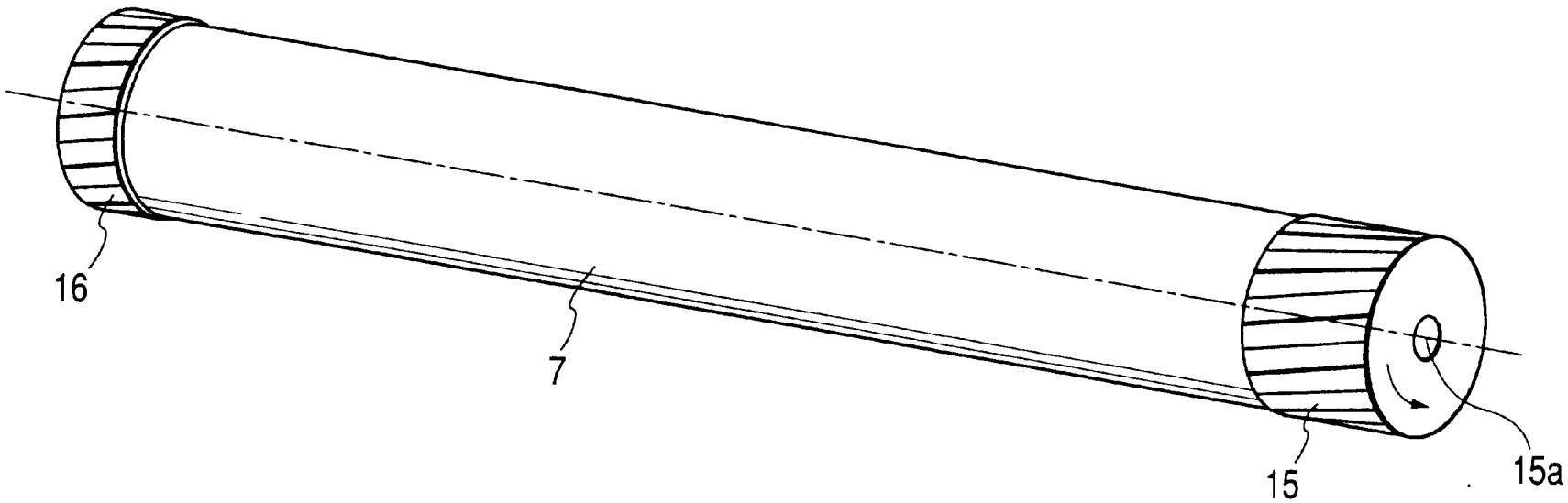
FIG. 5 is an external perspective view of a photosensitive drum embodying the present invention.

The cleaning unit contains the charging roller 8, the cleaning blade 10*a*, and the photosensitive drum unit 7*u* in the cleaning frame 13. In the photosensitive drum unit 7*u*, as shown in FIG. 4, the photosensitive drum 7 is provided, at the respective ends thereof, with a drum gear 15 and a transfer roller driving gear 16 and is rotatably supported by the cleaning frame 13. The drum gear 15 and the transfer roller driving gear 16 are helical gears with a same twisting direction of the tooth trace. The drum gear 15 at one end is driven by a driving gear 17 which is driven, through driving force transmitting members, by a driving motor in the main body 14 of the apparatus, while the transfer roller driving gear 16 at the other end transmits the driving force from the photosensitive drum unit 7*u* to the transfer roller 4 by a transfer roller gear 4*a* fixed on the transfer roller shaft 4*b* thereof. The drum gear 15 constitutes a member for receiving the driving force for driving the process cartridge B, and the rotation is transmitted from the drum gear 15 through an unrepresented gear train to the toner feeding member 9*b* and the toner agitating members 9*e*, 9*f*. The drum gear 15 and the transfer roller driving gear 16 provided on both ends of the drum cylinder 7*d* of the photosensitive drum 7 serve as supporting flanges for the photosensitive drum 7, and a drum shaft hole 15*a* (cf. FIG. 5) and an unrepresented shaft hole of the transfer roller driving gear 16 rotatably fit onto fixed shafts 13*a*, 13*b* fixed on the cleaning frame 13. The lateral end surface of the drum gear 15 is in contact with a shoulder 13*a*1 of the fixed shaft 13*a* to define the position of the photosensitive drum 7 in the axial direction thereof. Also, the transfer roller shaft 4*b* integral with the transfer roller 4 is rotatably supported, at the longitudinal ends thereof, by bearings 14*a*, 14*b* fixed on the main body 14 of the image forming apparatus. The bearing 14*a*, positioned at the side of the fixed shaft 13*a* for supporting the drum gear 15 in the longitudinal direction, is provided with a thrust receiving surface 14*a*1 against which the end of the transfer roller shaft 4*b* abuts, thereby defining the position of the transfer roller 4 in the axial direction thereof.

In the image forming apparatus A of the present embodiment, as explained in the foregoing, the axial position of the transfer roller 4 in the main body 14 of the image forming apparatus and the photosensitive drum 7 in the process cartridge B is defined by the shoulder 13*a*1 of the aforementioned fixed shaft 13*a* and the thrust receiving surface 14*a*1 of the bearing 14*a*, positioned at the same side in the longitudinal direction. Also in case the photosensitive drum 7 is supported by fixing the rotary shaft on the drum unit 7*u* and effecting rotary support by the cleaning frame 13, the position of the photosensitive drum 7 and the transfer roller 4 is defined with reference to a same side in the longitudinal direction as explained in the foregoing.

The drum gear 15 has 34 teeth, a diameter of the reference pitch circle of 32.175 mm, a module of 0.9, a left hand helix with a helix angle of 18°, and a face width of 21 mm.

The transfer roller driving gear 16 has 42 teeth, a diameter of the reference pitch circle of 30.913 mm, a module of 0.7, a left hand helix with a helix angle of 18°, and a face width of 7.6 mm.

The driving gear 17 of the main body 14 has 41 teeth, a diameter of the reference pitch circle of 38.799 mm, a module of 0.9, a right hand helix with a helix angle of 18°, and a face width of 15 mm.

The transfer gear 4*a* has 23 teeth, a diameter of the reference pitch circle of 16.93 mm, a module of 0.7, a right hand helix with a helix angle of 18°, and a face width of 3.5 mm.

The drum gear 15, driven by the driving gear 17 of the main body 14, drives the developing unit D as explained in the foregoing. The gears 15, 16 at both ends of the photosensitive drum 7 are fixed, for example by caulking, to a drum cylinder 7*d* constituted by a hollow aluminum cylinder having the photosensitive layer 7*a* on the external periphery thereof. The gears 15, 16 coupled on both ends of the photosensitive drum unit 7*u* are both helical gears with a same hand helix with a same helix angle of 18°. The photosensitive drum unit 7*u* has a play of 1 to 5 mm in the longitudinal direction, with respect to the cleaning frame 13.

The helix of the tooth trace of the drum gear 15 is so directed, when it is driven by the driving gear 17 of the main body 14, that the photosensitive drum unit 7*u* moves toward the drum gear 15 in the longitudinal direction by the thrust force of the drum gear 15. Also, the tooth trace of the transfer roller driving gear 16 has a helix direction the same as that of the tooth trace of the drum gear 15, whereby the transfer roller 4, when it is driven, moves in the same direction as that of the photosensitive drum unit 7*u*.

In the following, there will be explained the movement of the photosensitive drum unit 7*u* and the transfer roller 4 in the same direction. When the driving gear 17 so rotates that the periphery thereof moves in a direction indicated by the arrow a in FIG. 4, the drum gear 15 so rotates that the periphery thereof moves in a direction indicated by the arrow b. Thus, the photosensitive drum unit 7*u* generates a thrust force F1 toward right in FIG. 4. By the above-mentioned rotation of the drum gear 15, the transfer roller driving gear 16 so rotates that the periphery thereof moves in a direction indicated by the arrow c, and the transfer roller gear 4*a* so rotates that the periphery thereof moves in a direction indicated by the arrow d. Thus, by repulsive force, the photosensitive drum unit 7*u* receives a thrust force F2 toward left in the drawing and the transfer roller 4 receives a thrust force F3 toward right in the drawing.

The load of the transfer roller 4 is received by the transfer roller driving gear 16. In addition to the load from the transfer roller 4, the drum gear 15 receives a load for driving the developing unit D including the developing roller 9*c*, a load resulting from the frictional resistance of the bearings supporting the photosensitive drum unit 7*u* due to the pressure contacts of the transfer roller 4 and the developing roller 9*c* with the photosensitive drum 7, a load resulting from the frictional resistance between the cleaning blade 10*a* and the photosensitive drum 7, etc. On the other hand, the diameter of the pitch circle of the drum gear 15 is slightly larger than that of the transfer roller driving gear 16. Also, the diameter of the pitch circle of the drum gear 15 is generally slightly larger than that of the transfer roller driving gear 16. As the specifications of the gears 15, 16 are so selected that the thrust force F1 based on the tooth load received by the drum gear 15 is larger than the thrust force F2 generated by the repulsive force to the tooth load of the transfer roller driving gear 16, the photosensitive drum unit 7*u* is biased in the direction of the thrust force F1. This direction is same as that of the thrust force F3 of the transfer roller 4. Consequently the transfer roller 4 and the photosensitive drum unit 7*u* move in the same direction, so that the positioning in the longitudinal direction can be made at the same side and the thrust bearings can be positioned closer to improve the positional precision.

The transfer roller driving gear 16 receives a thrust force in a direction opposite to that in the drum gear 15, but such thrust force is smaller because the transfer roller driving gear 16 is at a downstream position with respect to the drum gear 15 in the transmission path of the driving force, thus resulting in a loss in the transmission of torque, and also because the gears 15, 16 have a same helix angle but have a small difference in the diameter of the pitch circle, whereby the photosensitive drum unit 7*u* moves toward the drum gear 15. Also, the gears 15, 16 connected to the photosensitive drum unit 7*u*, being composed of helical gears, realize smoother transmission of the driving force in comparison with the spur gears, whereby the unevenness in rotation and the vibration can be reduced in the transfer roller 4 and the photosensitive drum 7 to achieve improved image quality.

In the above-described embodiment, the diameter of the pitch circle of the drum gear 15 is made larger than that of the transfer roller driving gear 16 but the teeth of these gears have a same helix angle. With such same helix angle of the teeth, the thrust forces F1, F2 of the drum gear 15 and the transfer roller driving gear 16 are mutually equal when the tooth loads of the gears 15, 16 become mutually equal. There is only required a condition F1>F2, and, for obtaining a sufficiently large difference ΔF=F1−F2, it is preferable to select substantially the same diameters for the pitch circles of the gears 15 and 16, and, more preferably the diameter of the pitch circle of the drum gear 15 is selected to be smaller than that of the transfer roller driving gear 16.

Then, in case the drum gear 15 and the transfer roller driving gear 16 have a same diameter of the pitch circle and the same helix angle, there results F1>F2 because the tooth load is larger in the drum gear 15 than in the transfer roller driving gear 16. In consideration of the relationship of the tooth load, the helix angle of the drum gear 15 may be selected to be smaller, within a certain range, than that of the transfer roller driving gear 16.

The above-described relationships can be summarized in the following manner, neglecting the fact that the developing roller 9*c* is driven by the drum gear 15.

There is required the following condition in order that the thrust force F1 generated in the drum gear 15 becomes larger than the thrust force F2 generated in the transfer roller driving gear 16:

$$P \tan \theta 1 > KW \tan \theta 2$$

wherein

P: tooth load (tangential load) of the drum gear 15

W: tooth load (tangential load) of the transfer roller driving gear 16

θ1: helix angle of the drum gear 15

θ2: helix angle of the transfer roller driving gear 16

K: ratio of the diameters of pitch circles of the drum gear 15 and the transfer roller driving gear 16.

However, this relationship does not consider the frictional coefficient of meshing of the teeth and the pressure angle.

In the present invention, therefore, the specifications of the drum gear 15 and the transfer roller driving gear 16 are selected according to such relationship.

In the description of the foregoing relationship, there is neglected the influence of the developing roller gear (not shown) which is coaxial with the developing roller 9*c* and meshes with the drum gear 15. However, since the developing roller gear is driven by the drum gear 15, a thrust component of the tooth load between the developing roller gear and the drum gear 15 is added to the aforementioned thrust force F1 of the drum gear 15. Consequently, for a safer side, the specifications of the drum gear 15 and the transfer roller driving gear 16 are selected as explained in the foregoing.

The foregoing embodiments of the present invention can be summarized in the following manner:

1. An electrophotographic photosensitive drum 7 for use in the main body 14 of the electrophotographic image forming apparatus, comprising:

a drum cylinder 7*d* having a photosensitive layer 7*a* on the periphery thereof;

a first helical gear as the transfer roller driving gear 16 provided at one end of the cylinder 7*d*; and a second helical gear as the drum gear 15 provided at the other end of the cylinder 7*d*, and having the same hand helix as that of the first helical gear 16 and a number of teeth less than that of the first helical gear 16.

2. An electrophotographic photosensitive drum according to the item 1, wherein the first helical gear 16 has a diameter of the reference pitch circle smaller than that of the second helical gear 15.

3. An electrophotographic photosensitive drum according to the item 1 or 2, wherein the first helical gear 16 and the second helical gear 15 have a same helix angle.

4. An electrophotographic photosensitive drum according to any one of the items 1 to 3, wherein the diameter of the reference pitch circle of the first helical gear 16 is about 31 mm, while the diameter of the reference pitch circle of the second helical gear 15 is 32 mm.

5. An electrophotographic photosensitive drum according to any one of the items 1 to 3, wherein the first helical gear 16 has 42 teeth while the second helical gear 15 has 34 teeth.

6. An electrophotographic photosensitive drum according to any one of the items 1 to 5, wherein the first helical gear 16 and the second helical gear 15 have a helix angle of about 18° and a right hand helix.

7. An electrophotographic photosensitive drum according to the item 1, wherein, when the photosensitive drum 7 is mounted in the main body 14 of the above-mentioned apparatus, the first helical gear 16 serves to transmit the rotary driving force, received by the photosensitive drum 7 from the main body 14 of the apparatus, to a transfer roller 4 provided in the main body 14 of the apparatus.

8. An electrophotographic photosensitive drum according to the item 1, wherein, when the photosensitive drum 7 is mounted in the main body 14 of the above-mentioned apparatus, the second helical gear 15 serves to receive the driving force for rotating the photosensitive drum 7 from the main body 14 of the apparatus and to transmit the rotary driving force, received from the main body 14 of the apparatus, to a developing roller 9*c*.

9. An electrophotographic photosensitive drum according to any one of the items 1 to 8, wherein the electrophotographic photosensitive drum 7 is constructed as a cartridge integrally with the developing roller 9*c* for developing an electrostatic latent image formed on the electrophotographic photosensitive drum 7, and is provided in a process cartridge B which is detachably mountable to the main body 14 of the above-mentioned electrophotographic image forming apparatus.

10. A process cartridge B detachably mountable to the main body 14 of the electrophotographic image forming apparatus comprising:

(a) an electrophotographic photosensitive drum 7 including:

a cylinder 7*d* having a photosensitive member 7*a* on the periphery thereof;

a first helical gear 16 provided at one end of the cylinder 7*d;* and a second helical gear 15 provided at the other end of the cylinder 7*d,* and having the same hand helix as that of the first helical gear 16 and a number of teeth less than that of the first helical gear 16; and (b) a developing roller 9*c* as a developing member for developing an electrostatic latent image formed on the electrophotographic photosensitive drum 7;

wherein, when the process cartridge B is mounted in the main body 14 of the above-mentioned apparatus, the second helical gear 15 serves to receive, from the main body 14 of the apparats, the driving force for rotating the photosensitive drum 7 and to transmit the rotary driving force received from the main body 14 of the apparatus to the developing roller 9*c* as the developing member, and the first helical gear 16 serves to transmit the driving force for rotating the transfer roller 4 provided in the main body 14 of the apparatus to the transfer roller 4.

The above-described embodiments allow smooth transmission of the driving force from the electrophotographic photosensitive drum to the transfer means, thereby obtaining a satisfactory image. Also, the positions of the electrophotographic photosensitive drum and the transfer means can be defined at a same side in the longitudinal direction, whereby improved is the positional precision of the electrophotographic photosensitive drum and the transfer means.

Thus, as explained in the foregoing, the present invention enables smooth transmission of the driving force.

While the invention has been described with reference to the structures disclosed herein, it is not confined to the details set forth and this application is intended to cover such modifications or changes as may come within the purposes of the improvements or the scope of the following claims.

What is claimed is:

1. An electrophotographic photosensitive drum for use in a main body of an electrophotographic image forming apparatus, comprising:

a cylinder provided with a photosensitive member on a periphery thereof;

a first helical gear provided at one end of said cylinder; and a second helical gear provided at the other end of said cylinder and having the same hand helix as that of said first helical gear and a number of teeth less than that of said first helical gear.

2. An electrophotographic photosensitive drum according to claim 1, wherein said first helical gear has a diameter of a reference pitch circle smaller than a diameter of a reference pitch circle of said second helical gear.

3. An electrophotographic photosensitive drum according to claim 1 or 2, wherein said first helical gear and said second helical gear have the same helix angle.

4. An electrophotographic photosensitive drum according to claim 1 or 2, wherein a diameter of a reference pitch circle of said first helical gear is about 31 mm while a diameter of a reference pitch circle of said second helical gear is 32 mm.

5. An electrophotographic photosensitive drum according to claim 1 or 2, wherein said first helical gear has 42 teeth while said second helical gear has 34 teeth.

6. An electrophotographic photosensitive drum according to claim 1 or 2, wherein said first helical gear and said second helical gear have a helix angle of about 18° and a left hand helix.

7. An electrophotographic photosensitive drum according to claim 1, wherein, when said photosensitive drum is mounted in the main body of said apparatus, said first helical gear transmits a rotary driving force, which has been received by said second helical gear from the main body of said apparatus and transmitted to said first helical gear through said cylinder, to a transfer roller provided in the main body of said apparatus.

8. An electrophotographic photosensitive drum according to claim 1, wherein, when said photosensitive drum is mounted in the main body of said apparatus, said second helical gear receives a rotary driving force for rotating said photosensitive drum from the main body of said apparatus and transmits the rotary driving force, received from the main body of said apparatus, to a developing roller.

9. An electrophotographic photosensitive drum according to claim 1, 2, 7 or 8, wherein said electrophotographic photosensitive drum is constructed as a cartridge integrally with a developing roller for developing an electrostatic latent image formed on said electrophotographic photosensitive drum, and is provided in a process cartridge which is detachably mountable to the main body of said electrophotographic image forming apparatus.

10. A process cartridge detachably mountable to a main body of an electrophotographic image forming apparatus, comprising:

(a) an electrophotographic photosensitive drum including:

a cylinder having a photosensitive member on a periphery thereof;

a first helical gear provided at one end of said cylinder; and a second helical gear provided at the other end of the cylinder and having the same hand helix as that of said first helical gear and a number of teeth less than that of said first helical gear; and (b) a developing member for developing an electrostatic latent image formed on said electrophotographic photosensitive drum;

wherein, when the process cartridge is mounted in the main body of said apparatus, said second helical gear receives, from the main body of said apparatus, a rotary driving force for rotating said photosensitive drum and transmits the rotary driving force received from the main body of said apparatus to a developing roller as said developing member, and said first helical gear transmits a rotary driving force, which has been received by said second helical gear from the main body of said apparatus and transmitted to said first helical gear through said cylinder, for rotating a transfer roller provided in the main body of said apparatus to said transfer roller.

11. A process cartridge detachably mountable to a main body of an image forming apparatus, comprising:

an electrophotographic photosensitive drum;

process means acting on said electrophotographic photosensitive drum;

a transfer roller driving gear connected to one end of said electrophotographic photosensitive drum and transmitting a driving force to a transfer roller provided in the main body of said image forming apparatus; and a cartridge driven gear connected to the other end of said electrophotographic photosensitive drum and receiving a driving force from an apparatus driving gear in the main body of said image forming apparatus;

wherein said cartridge driven gear and said transfer roller driving gear are respectively helical gears whose tooth traces have the same hand helix.

12. A process cartridge according to claim 11, wherein specifications of the gears are so selected that a thrust force generated in said cartridge driven gear is larger than a thrust force generated in said transfer roller driving gear.

13. A process cartridge according to claim 12, wherein a direction of the thrust force generated in said cartridge driving gear is the same as a direction of a thrust force acting on said transfer roller.

14. A process cartridge according to claim 11, 12, or 13, wherein said cartridge driven gear and said transfer roller driving gear have substantially the same helix angles.

15. A process cartridge according to claim 11, 12, or 13, wherein said cartridge driven gear has a diameter of a pitch circle smaller than or substantially equal to a diameter of a pitch circle of said transfer roller driving gear.

16. A process cartridge according to claim 12 or 13, wherein a positioning portion for positioning said electrophotographic photosensitive drum in an axial direction of said electrophotographic photosensitive drum is provided ahead in a direction along which the thrust force generated in said cartridge driven gear is directed.

17. A process cartridge according to claim 12 or 13, wherein said process means includes at least one of charging means, developing means and cleaning means.

18. An electrophotographic image forming apparatus to which a process cartridge is detachably mountable for forming an image on a recording medium, comprising:

(a) mounting means for detachably mounting the process cartridge, the process cartridge including:

an electrophotographic photosensitive drum;

process means acting on said electrophotographic photosensitive drum;

a transfer roller driving gear connected to one end of said electrophotographic photosensitive drum and transmitting a driving force to a transfer roller provided in a main body of said image forming apparatus; and a cartridge driven gear connected to the other end of said electrophotographic photosensitive drum and receiving a driving force from an apparatus driving gear in the main body of said image forming apparatus;

wherein said cartridge driven gear and said transfer roller driving gear are respectively helical gears whose tooth traces have the same hand helix;

(b) the apparatus driving gear for driving said cartridge driven gear;

(c) the transfer roller having a transfer gear meshing with said transfer roller driving gear; and (d) conveying means for conveying said recording medium.

19. An electrophotographic image forming apparatus to which a process cartridge is detachably mountable for forming an image on a recording medium, comprising:

(a) mounting means for detachably mounting the process cartridge, the process cartridge including:

an electrophotographic photosensitive drum;

process means acting on said electrophotographic photosensitive drum;

a cartridge driven gear connected to said electrophotographic photosensitive drum and receiving a driving force from an apparatus driving gear in a main body of said image forming apparatus; and a transfer roller driving gear connected to said electrophotographic photosensitive drum and transmitting a driving force to a transfer roller provided in the main body of said image forming apparatus;

wherein said cartridge driven gear and said transfer roller driving gear are respectively helical gears whose tooth traces have the same hand helix, and a positioning portion for positioning said electrophotographic photosensitive drum in an axial direction of said electrophotographic photosensitive drum is provided ahead in a direction along which a thrust force generated in said cartridge driven gear is directed;

(b) the apparatus driving gear for driving said cartridge driven gear;

(c) the transfer roller having a transfer gear meshing with said transfer roller driving gear;

(d) a positioning portion for the transfer roller, provided at the same side in an axial direction as the positioning portion for said electrophotographic photosensitive drum; and (e) conveying means for conveying said recording medium.

20. An electrophotographic photosensitive drum for use in a main body of an electrophotographic image forming apparatus, comprising:

a cylinder provided with a photosensitive member on a periphery thereof;

a first helical gear provided at one end of said cylinder; and a second helical gear provided at the other end of said cylinder and having a same hand helix as that of said first helical gear and a number of teeth less than that of said first helical gear, wherein a face width of said first helical gear is smaller than a face width of second helical gear, wherein when said electrophotographic photosensitive drum is mounted in the main body of the apparatus, said first helical gear transmits a rotary driving force, which has been received by said second helical gear from the main body of the apparatus, to a transfer roller provided in the main body of the apparatus, wherein when said electrophotographic photosensitive drum is mounted in the main body of the apparatus, said second helical gear receives the rotary driving force for rotating said electrophotographic photosensitive drum from the main body of the apparatus and transmits the rotary driving force received from the main body of the apparatus to a developing roller, and wherein said developing roller develops an electrostatic latent image formed on said electrophotographic photosensitive drum.

21. An electrophotographic photosensitive drum according to claim 20, wherein said first helical gear has 42 teeth, said second helical gear has 34 teeth and said first helical gear has a diameter of a reference pitch circle smaller than a diameter of a reference pitch circle of said second helical gear.

22. An electrophotographic photosensitive drum according to claim 20 or 21, wherein said first helical gear and said second helical gear have a left hand helix.

23. An electrophotographic photosensitive drum according to claim 22, wherein a module of said first helical gear is smaller than a module of said second helical gear.

24. An electrophotographic photosensitive drum according to claim 20, wherein said electrophotographic photosensitive drum is provided integrally with said developing roller in a process cartridge which is detachably mountable to the main body of the image forming apparatus, and wherein said electrophotographic photosensitive drum is mounted in the main body of the image forming apparatus by mounting said process cartridge in the main body of the image forming apparatus.

25. An electrophotographic photosensitive drum according to claim 20, wherein said first helical gear and said second helical gear from a same helix angle.

26. An electrophotographic photosensitive drum for use in main body of an electrophotographic image forming apparatus, comprising:

a cylinder provided with a photosensitive member on a periphery thereof;

a first helical gear provided at one end of said cylinder; and a second helical gear provided at the other end of said cylinder and having a same hand helix as that of said first helical gear and a number of teeth less than that of said first helical gear, wherein a face width of said first helical gear is smaller than a face width of said second helical gear, wherein when said electrophotographic photosensitive drum is mounted in the main body of the apparatus, said first helical gear transmits a rotary driving force, which has been received by said second helical gear from the main body of the apparatus, to a transfer roller provided in the main body of the apparatus, wherein when said electrophotographic photosensitive drum is mounted in the main body of the apparatus, said second helical gear receives the rotary driving force for rotating said electrophotographic photosensitive drum from the main body of the apparatus and transmits the rotary driving force received from the main body of the apparatus to a developing roller, wherein said developing roller develops an electrostatic latent image formed on said electrophotographic photosensitive drum, wherein said first helical gear has 42 teeth, said second helical gear has 34 teeth and said first helical gear has a diameter of a reference pitch circle smaller than a diameter of a reference pitch circle of said second helical gear, and wherein said first helical gear and said second helical gear have a same helix angle.

27. An electrophotographic photosensitive drum according to claim 26, wherein said first helical gear and said second helical gear have a left hand helix.

28. An electrophotographic photosensitive drum according to claim 26 or 27, wherein a module of said first helical gear is smaller than a module of said second helical gear.

29. An electrophotographic photosensitive drum according to claim 28, wherein said electrophotographic photosensitive drum is provided integrally with said developing roller in a process cartridge which is detachably mountable to the main body of the image forming apparatus, and wherein said electrophotographic photosensitive drum is mounted in the main body of the image forming apparatus by mounting said process cartridge in the main body of the image forming apparatus.

30. A process cartridge detachably mountable to a main body of an electrophotographic image forming apparatus, comprising:

(a) an electrophotographic photosensitive drum; and (b) a developing roller for developing an electrostatic latent image formed on said electrophotographic photosensitive drum, said electrophotographic photosensitive drum including:

a cylinder provided with a photosensitive member on a periphery thereof;

a first helical gear provided at one end of said cylinder; and a second helical gear provided at the other end of said cylinder and having a same hand helix as that of said first helical gear and a number of teeth less than that of said first helical gear, wherein a face width of said first helical gear is smaller than a face width of said second helical gear, wherein when said electrophotographic photosensitive drum is mounted in the main body of the apparatus, said first helical gear transmits a rotary driving force, which has been received by said second helical gear from the main body of the apparatus, to a transfer roller provided in the main body of the apparatus, and wherein when said electrophotographic photosensitive drum is mounted in the main body of the apparatus, said second helical gear receives the rotary driving force for rotating said electrophotographic photosensitive drum from the main body of the apparatus and transmits the rotary driving force received from the main body of the apparatus to said developing roller.

31. A process cartridge detachably mountable to a main body of an electrophotographic image forming apparatus, comprising:

(a) an electrophotographic photosensitive drum; and (b) a developing roller for developing an electrostatic latent image formed on said electrophotographic photosensitive drum, said electrophotographic photosensitive drum including:

a cylinder provided with a photosensitive member on a periphery thereof;

a first helical gear provided at one end of said cylinder; and a second helical gear provided at the other end of said cylinder and having a same hand helix as that of said first helical gear and a number of teeth less than that of said first helical gear, wherein a face width of said first helical gear is smaller than a face width of said second helical gear, wherein when said electrophotographic photosensitive drum is mounted in the main body of the apparatus, said first helical gear transmits a rotary driving force, which has been received by said second helical gear from the main body of the apparatus, to a transfer roller provided in the main body of the apparatus, wherein when said electrophotographic photosensitive drum is mounted in the main body of the apparatus, said second helical gear receives the rotary driving force for rotating said electrophotographic photosensitive drum from the main body of the apparatus and transmits the rotary driving force received from the main body of the apparatus to said developing roller, wherein said first helical gear has 42 teeth, said second helical gear has 34 teeth and said first helical gear has a diameter of a reference pitch circle smaller than a diameter of a reference pitch circle of said second helical gear, and wherein said first helical gear and said second helical gear have a same helix angle.

* * * * *

UNITED STATES PATENT AND TRADEMARK OFFICE

CERTIFICATE OF CORRECTION

PATENT NO. : 6,282,389 B1
DATED : August 28, 2001
INVENTOR(S) : Hiroomi Matsuzaki et al.

It is certified that error appears in the above-identified patent and that said Letters Patent is hereby corrected as shown below:

Column 2,
Line 65, "is" should be deleted.
Line 66, "to" (2nd occurrence) should be deleted.

Column 9,
Line 61, "apparats," should read -- apparatus, --.

Column 13,
Line 49, "from" should read -- form --.

Signed and Sealed this

Fourth Day of March, 2003

JAMES E. ROGAN
*Director of the United States Patent and Trademark Office*